US006447648B1

(12) United States Patent
Slagowski et al.

(10) Patent No.: US 6,447,648 B1
(45) Date of Patent: Sep. 10, 2002

(54) ANISOTROPIC REINFORCED RIBBON-CAST BLANKET FOR EXTENDED NIP PRESS

(75) Inventors: Eugene L. Slagowski, Williamsburg, VA (US); Paul McCarten, Clarks Summit, PA (US)

(73) Assignees: Metso Paper, Inc., Helsinki (FI); Mitsubishi Heavy Industries, Ltd., Tokyo (JP)

( * ) Notice: Subject to any disclaimer, the term of this patent is extended or adjusted under 35 U.S.C. 154(b) by 949 days.

(21) Appl. No.: 08/696,248

(22) Filed: Aug. 13, 1996

(51) Int. Cl.[7] ..... D21F 3/02

(52) U.S. Cl. ..... 162/358.4; 162/901; 264/129; 264/137

(58) Field of Search ..... 162/358.4, 901; 264/129, 137; 198/846, 847

(56) References Cited

U.S. PATENT DOCUMENTS

| | | | | |
|---|---|---|---|---|
| 4,229,253 A | | 10/1980 | Cronin | 162/358 |
| 4,229,254 A | | 10/1980 | Gill | 162/358 |
| 4,238,287 A | | 12/1980 | Gill | 162/358 |
| 4,353,296 A | | 10/1982 | Beucker | 100/121 |
| 4,551,894 A | | 11/1985 | Beucker | 29/130 |
| 4,552,620 A | | 11/1985 | Adams | 162/358 |
| 4,908,103 A | | 3/1990 | Cronin et al. | 162/358 |
| 4,944,820 A | | 7/1990 | McCarten | 156/154 |
| 4,944,844 A | | 7/1990 | Marcinko | 162/205 |
| 4,946,731 A | * | 8/1990 | Dutt | 162/901 |
| 4,973,383 A | | 11/1990 | Filzen | 162/358 |
| 5,201,978 A | | 4/1993 | McCarten et al. | 156/154 |
| 5,208,087 A | | 5/1993 | Stigberg | 428/60 |

FOREIGN PATENT DOCUMENTS

| | | | | |
|---|---|---|---|---|
| WO | 95/16820 | * | 6/1995 | 162/901 |

* cited by examiner

*Primary Examiner*—Karen M. Hastings
(74) *Attorney, Agent, or Firm*—Lathrop & Clark LLP

(57) ABSTRACT

A Conventional blanket material, preferably a woven fabric or scrim, is formed into a loop of the desired dimensions and impregnated and coated with a two-component urethane resin. As the urethane is applied to the woven substrate, short fibers are introduced into the urethane through a nozzle which aligns the fibers to run in the cross-machine direction. The fibers are introduced in sufficient quantities to provide significant structural reinforcement of the urethane in the cross-machine direction. The coated blanket is then ground to a desired constant thickness and an array of parallel grooves running in the machine direction are milled into the urethane coating. The anisotropic fiber reinforcement provides sufficient modulus to the urethane system to prevent the grooves from collapsing under the applied loads of the extended nip press. The reinforcing fibers may be glass, carbon fiber, synthetic polymer or other structural fiber material.

6 Claims, 3 Drawing Sheets

ANISOTROPIC REINFORCED RIBBON-CAST BLANKET FOR EXTENDED NIP PRESS

FIELD OF THE INVENTION

The present invention relates to papermaking blankets in general, and to blankets having parallel grooves for use in an extended nip press in particular.

BACKGROUND OF THE INVENTION

Paper, once formed on the fourdrinier, has a high water content which must be reduced substantially to yield usable paper. One approach to removing this excess water is to run the formed web through an extended nip press apparatus. Such an apparatus has a backing roll which is engaged by a concave press shoe over an extended portion of the roll, hence forming a nip which is considerably extended over the line contact typically found between two opposed rolls. To facilitate movement of the paper web through the extended nip, the web and the press felt are supported by a continuous looped blanket which travels around the press shoe. The water removal capacity of the extended nip press is so great, that it is necessary to provide a multiplicity of circumferential parallel grooves in the press blanket to allow adequate draining of the pressed fluid. Typically the grooves have been cut in a polyurethane surface coating existing alone or formed on an underlying fabric substrate.

However, due to the great pressures applied to the press blanket, on the order of 800 pounds per linear inch, there is a tendency for the portions of the blanket between grooves to collapse and thereby block fluid flow through the grooves. A number of approaches to preventing this collapse have been developed. Higher hardness urethane resists collapse, but is more prone to fracture. Grooved covers for papermaking rolls have been proposed which employ a rubber compound having anisotropic properties provided by reinforcing fibers which restrict collapse in the cross-machine direction, but which allow flexure in the machine direction.

What is needed is an extended nip press blanket having a urethane surface with circumferential grooves which resists collapse and which may be economically fabricated.

SUMMARY OF THE INVENTION

The blanket for an extended nip press of this invention is formed in a urethane ribbon casting process. A conventional blanket material, preferably a woven fabric or scrim, is formed into a loop of the desired dimensions and impregnated and coated with a two component urethane resin. As the urethane is applied to the woven substrate, short fibers are introduced into the urethane through a nozzle which aligns the fibers to run in the cross-machine direction. The fibers are introduced in sufficient quantities to provide significant structural reinforcement of the urethane in the cross-machine direction. The coated blanket is then ground to a desired constant thickness and an array of parallel grooves running in the machine direction are milled into the urethane coating. The anisotropic fiber reinforcement provides sufficient modulus to the urethane system to prevent the grooves from collapsing under the applied loads of the extended nip press. The reinforcing fibers may be glass, carbon fiber, synthetic polymer or other structural fiber material.

It is a feature of the present invention to provide a grooved blanket for an extended nip press which will maintain its water channelling capabilities under applied loads.

It is also a feature of the present invention to provide a grooved blanket for an extended nip press which resists barrelling in the grooves.

It is another feature of the present invention to provide a process for forming an extended nip press blanket which has anisotropic reinforcement.

Further objects, features and advantages of the invention will be apparent from the following detailed description when taken in conjunction with the accompanying drawings.

DESCRIPTION OF THE PREFERRED EMBODIMENT

Figure 1:
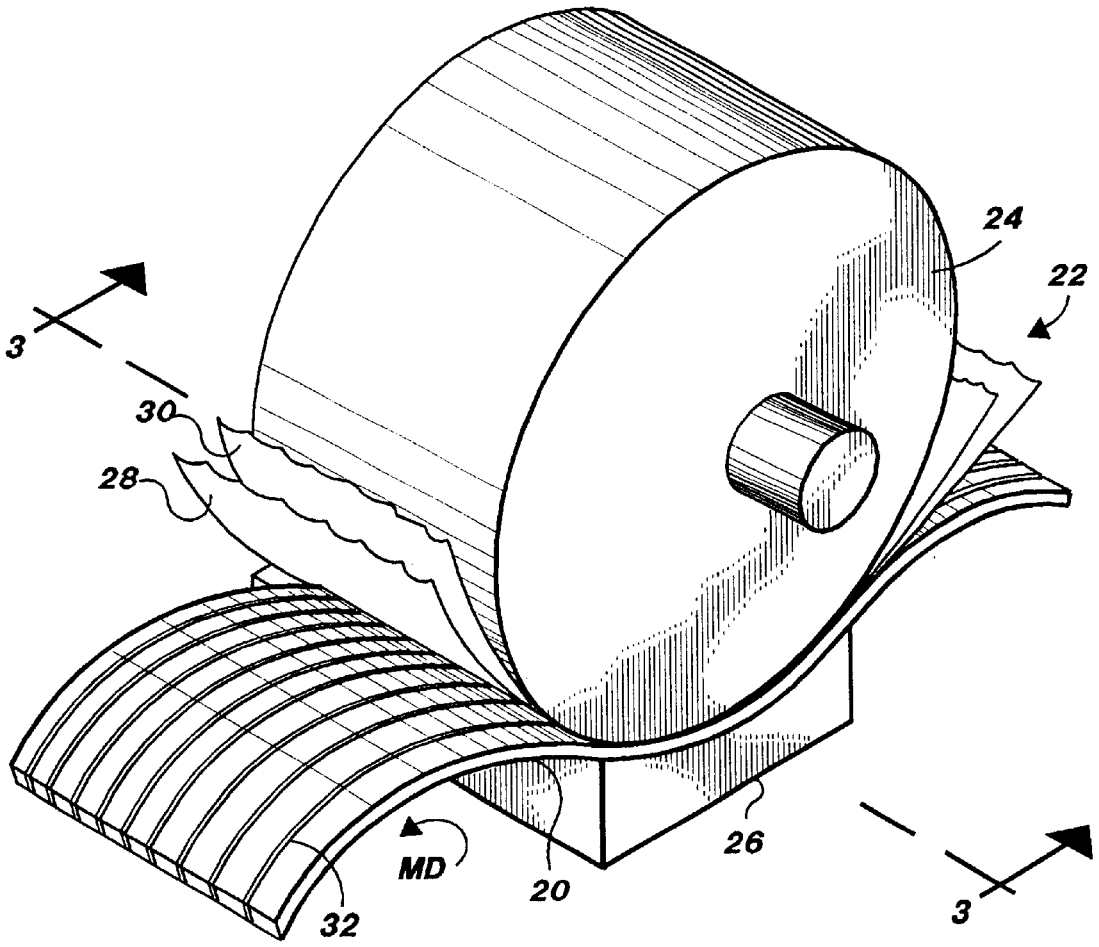
FIG. 1 is a schematic representation of an extended nip press employing the press blanket of this invention.

Referring more particularly to FIGS. 1–4 wherein like numbers refer to similar parts, the press blanket 20 of this invention is illustrated schematically in FIG. 1 in use within an extended nip press 22. The extended nip press 22 has a backing roll 24 which is opposed to a press shoe 26. The shoe has a concave surface which conforms to the cylindrical surface of the backing roll 24 and forms a nip between the backing roll 24 and the shoe 26. Tho blanket 20 forms a continuous loop which extends through the nip between the roll 24 and the shoe 26. A press felt 28 passes over the blanket 20, and a paper web 30 is supported on the felt as the blanket 20, felt 28, and web 30 pass through the nip. The shoe 26 is supported and urged against the roll 24 by a hydraulic piston (not shown). The extended nip press 22 is utilized in the pressing and drying of the paper web in the pressing and drying sections of a papermaking machine.

The passage of the blanket 20 over the concave surface of the press shoe 26 is facilitated by a film of oil which supports and lubricates the blanket's passage through the nip. The blanket performs several functions. First, the blanket supports the web and the felt as they pass through the nip. Second, the blanket prevents the oil film from coming into contact with or contaminating the paper web. Third, the blanket 20 is provided with a plurality of parallel grooves 32 which extend circumferentially around the blanket in the machine direction which provide a route for the escape of water pressed from the belt and the web.

Figure 2:
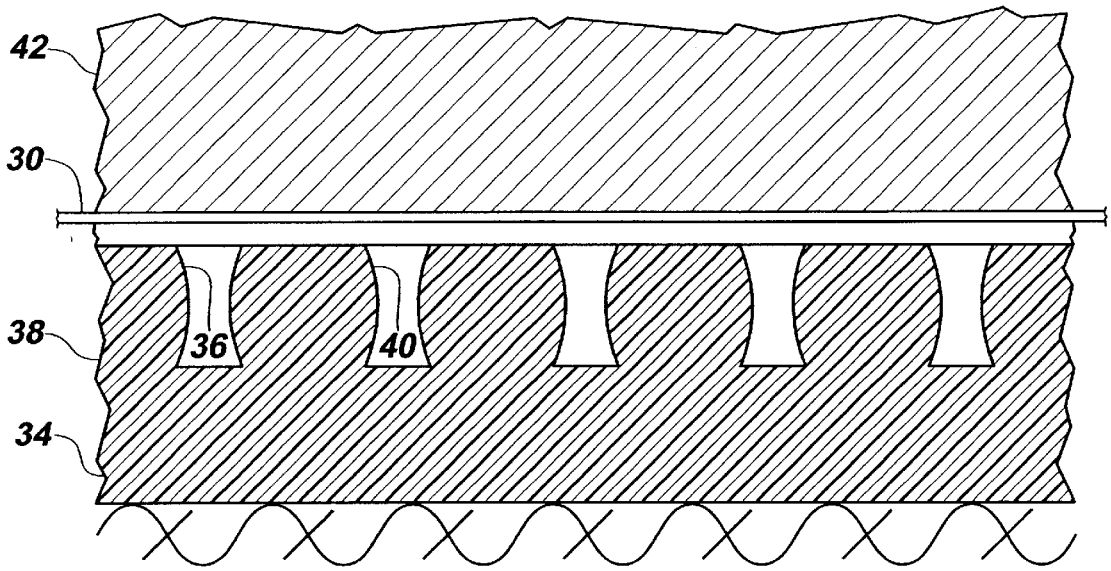
FIG.2 (PRIOR ART)
FIG. 2 is a cross-sectional view along the cross-machine plane of a prior art Dress blanket, illustrating the "barrelling" of the fluid relief grooves formed therein.

A prior art blanket 34 is shown in FIG. 2 which utilizes a conventional polyurethane coating on a backing substrate. The prior art blanket has a plurality of aligned grooves 36 which are ground into the resilient urethane layer 38. Urethane ribs 40 are defined between neighboring grooves 36. When subjected to the pressure of the backing roll 42 in the extended nip, the ribs 40 are deformed downwardly and caused to "barrel" outwardly, thereby partially or completely blocking the flow of fluid through the grooves. This flow blockage prevents the blanket 34 from fully relieving the liquid pressed from the paper web as it passes through the extended nip press and hence causes the extended nip press to operate at less than optimum efficiency.

Figure 3:
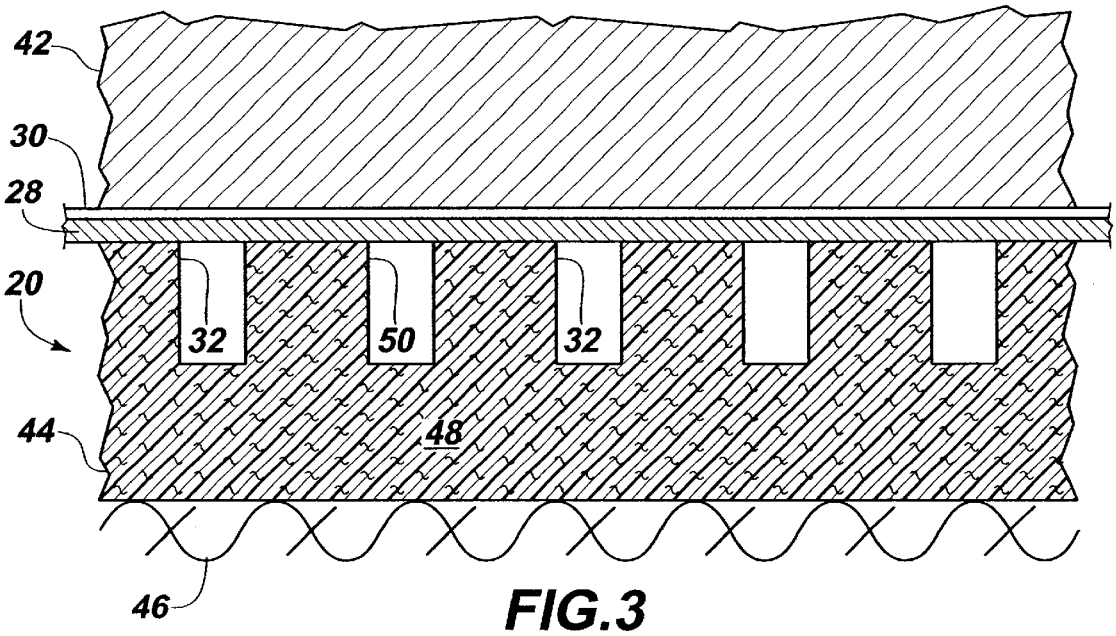
FIG. 3 is a cross-sectional view of the press blanket and engaged paper web and felt of this invention, taken along section line 3—3 in FIG. 1.

As shown in FIG. 3, the improved press blanket 20 of the present invention has a polyurethane layer 44 which is formed on a looped substrate 46 which is a woven fabric or scrim. The polyurethane layer 44 has a multitude of narrow diameter fibers 48 which extend generally in a cross-machine direction. The fibers 48 extend within the raised ribs 50 of the blanket 20 and provide some restraint to the outward bowing of the ribs. By preventing barreling, the reinforcing fibers help to keep the grooves 32 unobstructed and ready to channel water away from the nip. The fibers 48, however, extend predominantly in the cross-machine direction, so that they do not significantly restrict the flexibility of the blanket 20 in the machine direction, and hence do not hinder the ability of the blanket to conform to the press shoe 26 and the backing roll 24.

Figure 4:
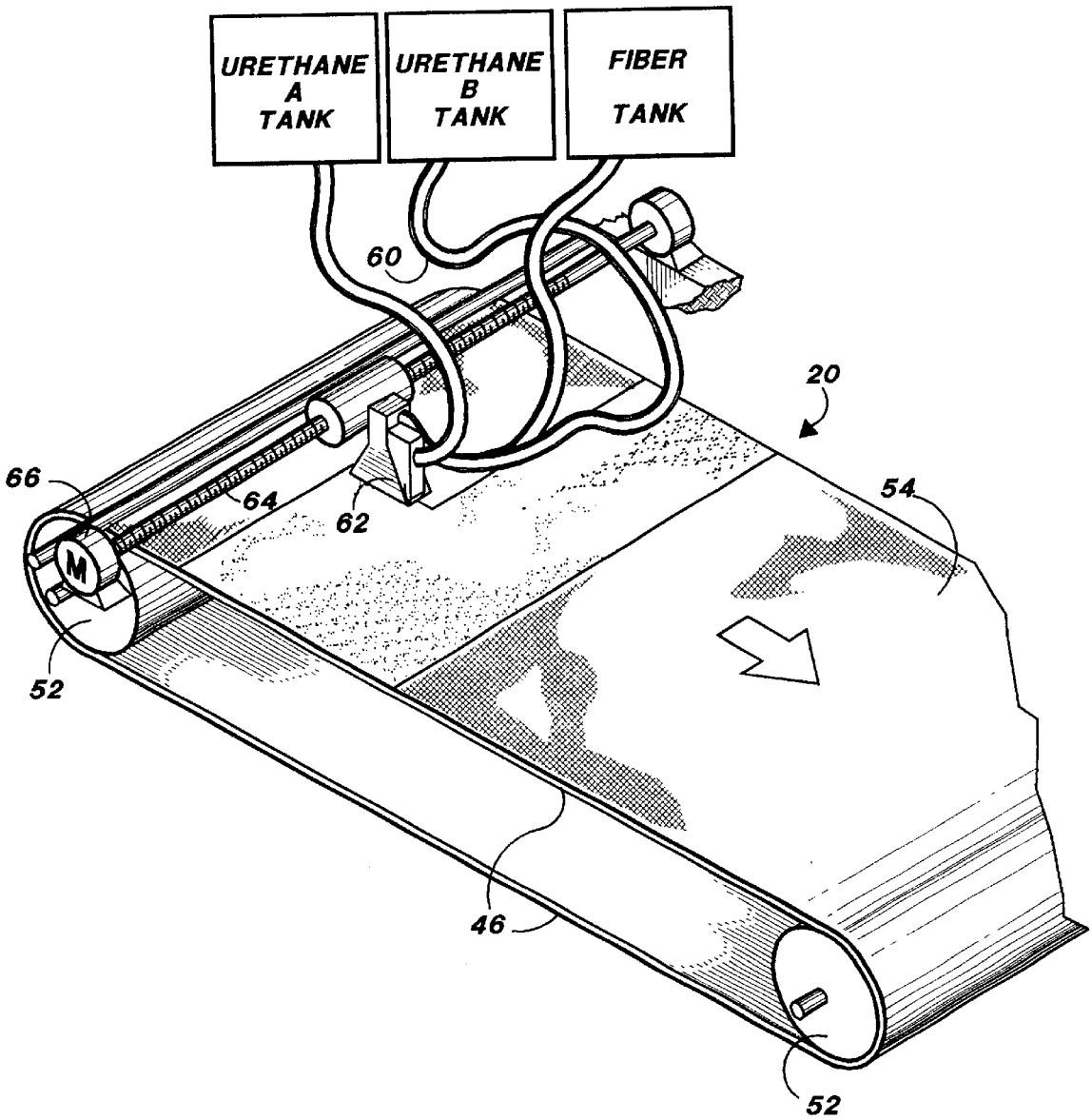
FIG. 4 is a somewhat schematic isometric view of polyurethane being applied in a ribbon-casting process to form the anisotropic press blanket of FIG. 3.

The formation of the press blanket 20 is illustrated in FIG. 4. The blanket 20 is formed by first looping the bare fabric substrate 46 around two support rollers 52. A top run 54 is defined between the two support rollers, and it is in this region that polyurethane is applied to the substrate 46. One of the rollers 52 is driven by an electric motor to advance the substrate along the run 54 as desired.

The two component polyurethane is supplied from two supply tanks, the A Tank, and the B Tank, as shown in FIG. 4. The two components are supplied under pressure through two flexible hoses 60 to a mixing head 62 which is closely spaced from the substrate surface. The mixing head can be driven back and forth across the looped blanket by any appropriately designed mechanical device. In an exemplary embodiment, the head 62 is mounted in a ball and screw relation to a screw rod 64 which extends across the substrate 46 in the cross machine direction of the blanket 20. An electric motor 66 drives the head 62 in a back and forth motion, which, together with the machine-direction motion of the substrate on the support rollers 52, enables polyurethane to be laid down on the substrate over the entire surface of the looped blanket 20. An example of a head which may be used is the FFH head from Edge-Sweets Company, Grand Rapids, Mich.

Fibers are introduced directly into the mixing head by a third stream dispensing device which can also vary the amount of fibers that are mixed into the polyurethane. The fibers are aligned during the flow of material out of the mixing head such that they are deposited in the direction of the movement of the mixing head.

The urethane-fiber mix is thus applied as a continuous ribbon. The width and thickness of the ribbon will depend on how fast the material is flowing. The ribbon may be from ¼ inch to 2 inches wide. The thickness of the applied mixture may be from $^{30}/_{1000}$ inches to $^{150}/_{1000}$ inches. The length of the fibers is from $^{1}/_{16}$th to 2 inches. It is desirable that a high aspect ration between the length and the diameter of the fibers be maintained. Various types of fibers may be employed, for example glass, graphite, KEVLAR (a trademark of Du Pont Co. for an aramid fiber), UHMW ("ultra-high molecular weight") polyethylene, carbon fiber, or other reinforcing material.

Once the urethane fiber mix has been applied, the blanket 20 may be ground to a consistent thickness, and the grooves 32 milled into the urethane layer. As shown in FIG. 3, the fibers 48 provide anisotropic reinforcement to the urethane, and hence resist barrelling of the grooves, while at the same time retaining the flexibility of the blanket in the machine direction.

It is understood that the invention is not limited to the particular construction and arrangement of parts herein illustrated and described, but embraces such modified forms thereof as come within the scope of the following claims.

We claim:

1. A blanket for an extended nip press comprising:

a blanket material forming a loop of a selected cross-machine dimension and a selected circumferential dimension, and a two component polyurethane resin impregnating the loop and forming a coating thereon, the polyurethane resin having short fibers embedded therein, the fibers being substantially aligned with the cross-machine direction, the fibers being in sufficient quantities to provide significant structural reinforcement of the urethane in the cross-machine direction, wherein the coating has portions defining a plurality of parallel grooves extending about the loop in the machine direction, and wherein the short fiber reinforcement reinforces the urethane to prevent the grooves from collapsing under the applied loads of an extended nip press.

2. The apparatus of claim 1 wherein the reinforcing fibers are chosen from the group consisting of graphite, KEVLAR (a trademark of Du Pont Co. for an aramid fiber), UHMW polyethylene, and carbon fiber.

3. A method of forming a press blanket for an extended nip press comprising the steps of:

looping a bare fabric substrate around two support rollers, the rollers defining a top run region between the two support rollers;

dispensing a two-component polyurethane to a dispenser head which is closely spaced from the substrate surface;

moving the dispenser head across the substrate in the cross-machine direction, and dispensing the two-component polyurethane onto the substrate;

conducting to the dispenser head fibers from a fiber supply;

introducing the fibers into the polyurethane as the polyurethane leaves the dispenser head, such that the fibers are aligned as they leave the nozzle in the direction of the motion of the dispenser head;

moving the looped substrate in a machine-direction with respect to the dispenser head to apply the polyurethane-fiber mix to the entire substrate;

grinding the substrate to a consistent thickness; and milling grooves into the polyurethane layer.

4. The method of claim 3 wherein the polyurethane-fiber mix is applied as a continuous ribbon, the ribbon having a width from ¼ inch to 2 inches and a thickness from $^{30}/_{1000}$ inches to $^{150}/_{1000}$ inches.

5. The method of claim 3 wherein the length of the fibers is from $^{1}/_{16}$th inch to 2 inches.

6. The method of claim 3 wherein the fibers introduced into the polyurethane are formed from a material selected from the group consisting of graphite, KEVLAR (a trademark of Du Pont Co. for an aramid fiber), UHMW polyethylene, and carbon fiber.

* * * * *